US011207583B2

(12) United States Patent
Chen

(10) Patent No.: US 11,207,583 B2
(45) Date of Patent: Dec. 28, 2021

(54) TRAMPOLINE FRAME

(71) Applicant: Samuel Chen, Causeway Bay (CN)

(72) Inventor: Samuel Chen, Causeway Bay (CN)

( * ) Notice: Subject to any disclaimer, the term of this patent is extended or adjusted under 35 U.S.C. 154(b) by 0 days.

(21) Appl. No.: 17/002,101

(22) Filed: Aug. 25, 2020

(65) Prior Publication Data

US 2020/0384338 A1 Dec. 10, 2020

Related U.S. Application Data

(63) Continuation-in-part of application No. 15/340,782, filed on Nov. 1, 2016, now abandoned, which is a continuation-in-part of application No. 29/582,229, filed on Oct. 26, 2016, now Pat. No. Des. 799,626.

(51) Int. Cl.
*A63B 5/11* (2006.01)
*A63B 71/00* (2006.01)

(52) U.S. Cl.
CPC ..... *A63B 71/0054* (2013.01); *A63B 5/11* (2013.01)

(58) Field of Classification Search
CPC ..... A63B 5/11
See application file for complete search history.

(56) References Cited

U.S. PATENT DOCUMENTS 6,135,922 A * 10/2000 Nissen ..... A63B 5/11 482/27
8,585,557 B2 * 11/2013 Ikegami ..... A63B 71/022 482/27
2002/0137598 A1 * 9/2002 Publicover ..... A63B 5/11 482/27
2009/0062078 A1 * 3/2009 VanElverdinghe ..... A63B 5/11 482/29
2011/0256985 A1 * 10/2011 Mann ..... A63B 5/11 482/27
2012/0252634 A1 * 10/2012 Ikegami ..... A63B 71/0054 482/29
2016/0030794 A1 * 2/2016 Yang ..... A63B 5/11 482/27

FOREIGN PATENT DOCUMENTS

EP 2377581 A2 * 10/2011 ..... A63B 5/11

* cited by examiner

*Primary Examiner* — Nyca T Nguyen
(74) *Attorney, Agent, or Firm* — Clement Cheng

(57) ABSTRACT

A trampoline has a horizontal bed frame. A bed is suspended across the horizontal bed frame. The horizontal frame includes a horizontally oriented bed frame for suspending the bed. Frame legs are attached to the horizontal frame for supporting the horizontal frame above a ground surface. An enclosure includes a net suspended from an upper enclosure loop. An enclosure frame includes enclosure poles formed as right oriented spiral section members and left oriented spiral section members preferably made from metal tubing such as steel tubing. The enclosure poles are diagonally oriented. The right oriented spiral section members intersect and are connected to the left oriented spiral section members at intermediate junctions to form X-shaped panels, namely a first X-shaped panel, a second. X-shaped panel and a third. X-shaped panel. At least three panels are used based upon the diameter of the enclosure frame.

18 Claims, 9 Drawing Sheets

TRAMPOLINE FRAME

This application is a continuation in part and claims priority from earlier filed U.S. utility patent Ser. No. 15/340,782 filed Nov. 1, 2016 entitled Trampoline Frame by same inventor Samuel Chen, which claims priority from design patent application No. 29/582,229 filed Oct. 26, 2016 also entitled Trampoline Frame by same inventor Samuel Chen, the disclosure of which is incorporated herein by reference.

FIELD OF THE INVENTION

The present invention is in the field of trampoline enclosures.

DISCUSSION OF RELATED ART

A variety of different trampolines have trampoline frames that are connected to enclosures. The enclosures contain a user within the trampoline bounding area with a net. A variety of different trampoline have a bounding area. The enclosures have a net and the net is supported by trampoline poles. The trampoline poles are typically vertical or arc-shaped members. For example, U.S. Pat. No. 6,053,845 entitled Trampoline Or The Like With Enclosure to inventor Publicover was issued Apr. 25, 2000, the disclosure of which is incorporated herein by reference, and provides for a trampoline enclosure with flexible vertical poles configured to flex inwardly to absorb force. The same inventor Publicover also describes cross bracing straps 144 in United States patent publication 20040121883 entitled Trampoline System, issued Jun. 24, 2004, the disclosure of which is incorporated herein by reference.

SUMMARY OF THE INVENTION

A trampoline has a horizontal bed frame. A bed is suspended across the horizontal bed frame. The horizontal frame includes a horizontally oriented bed frame for suspending the bed. Frame legs are attached to the horizontal frame for supporting the horizontal frame above a ground surface. An enclosure includes a net suspended from an upper enclosure loop.

An enclosure frame includes enclosure poles formed as right oriented spiral section members and left oriented spiral section members preferably made from metal tubing such as steel tubing. The enclosure poles are diagonally oriented. The right oriented spiral section members intersect and are connected to the left oriented spiral section members at intermediate junctions to form X-shaped panels, namely a first X-shaped panel, a second X-shaped panel and a third X-shaped panel. At least three panels are used based upon the diameter of the enclosure frame.

The X-shaped panels are connected sequentially to each other at X-shaped panel upper ends and at X-shaped panel lower ends. The first X-shaped panel is connected to a second X-shaped panel, and the second X-shaped panel is connected to a third X-shaped panel. The third X-shaped panel is not directly connected to the first X-shaped panel. A first lower branch connector connects the first X-shaped panel to the second X-shaped panel. A first upper branch connector connects the first X-shaped panel to the second X-shaped panel. A second lower branch connector connects the second. X-shaped panel to the third X-shaped panel. The first lower branch connector is not connected to the second lower branch connector. The first upper branch connector is not connected to the second upper branch connector. The first upper branch connector and the second upper branch connector are connected to the upper enclosure loop. The frame legs are connected to the lower branch connectors.

The X-shaped panels further include a fourth X-shaped panel connected to the third X-shaped panel. A fifth X-shaped panel is connected to the fourth X-shaped panel. A sixth X-shaped panel is connected to the first X-shaped panel. A first right oriented spiral section member is connected to the first lower branch connector. A second right oriented spiral section member is connected to the second lower branch connector. The third right oriented spiral section member is connected to the third lower branch connector. A fourth right oriented spiral section member is connected to a fourth lower branch connector. A fifth right oriented spiral section member is connected to a fifth lower branch connector. A sixth right oriented spiral section member is connected to a sixth lower branch connector. A first left oriented spiral section member is connected to the first lower branch connector. A second left oriented spiral section member is connected to a sixth lower branch connector. A third left oriented spiral section member is connected to a fifth lower branch connector. A fourth left oriented spiral section member is connected to a fourth lower branch connector. A fifth left oriented spiral section member is connected to the third lower branch connector. A sixth left oriented spiral section member is connected to the second lower branch connector.

The upper branch connectors are connected to left oriented spiral section members and right oriented spiral section members. A first right oriented spiral section member is connected to the second upper branch connector. The second right oriented spiral section member is connected to the third upper branch connector. The third right oriented spiral section member is connected to a fourth upper branch connector. The fourth right oriented spiral section member is connected to the fifth upper branch connector. The fifth right oriented spiral section member is connected to the sixth upper branch connector. The sixth right oriented spiral section member is connected to the first upper branch connector.

The first left oriented spiral section member is connected to the sixth upper branch connector. The second left oriented spiral section member is connected to the fifth upper branch connector. The third left oriented spiral section member is connected to the fourth upper branch connector. The fourth left oriented spiral section member is connected to the third upper branch connector. The fifth left oriented spiral section member is connected to the second upper branch connector. The sixth left oriented spiral section member is connected to the first upper branch connector.

Intermediate junctions connect the right oriented spiral section members to the left oriented spiral section members making X-shaped panels. The first right oriented spiral section member is connected to a sixth left oriented spiral section member at a first intermediate junction to make the first X-shaped panel. A second right oriented spiral section member is connected to a fifth left oriented spiral section member at a second intermediate junction to form the second X-shaped panel. A third right oriented spiral section member is connected to a fourth left oriented spiral section member at a third intermediate junction to form a third X-shaped panel. A fourth right oriented spiral section member is connected to the third left oriented spiral section member at a fourth intermediate junction to form a fourth X-shaped panel. A fifth right oriented spiral section member is connected to the second left oriented spiral section member at a fifth intermediate junction to form a fifth X-shaped panel. A sixth right oriented spiral section member is connected to a first left oriented spiral section member at a sixth intermediate junction to form a sixth X-shaped panel.

A number of X-shaped panel lower ends are connected to lower branch connectors. The lower branch connectors connect the X-shaped panels to each other and connect the X-shaped panels to the trampoline frame legs. An upper enclosure loop is connected to the enclosure poles at loop connectors mounted at the X-shaped panel upper ends. The enclosure is mounted inside the enclosure frame. The enclosure has a smaller diameter than the enclosure frame.

The first upper branch connector is spaced apart from the second upper branch connector. The first upper branch connector and the second upper branch connector are connected to the upper enclosure loop. A cross brace junction cover covers the intermediate junctions formed at the X-shaped panel middle. The upper enclosure loop is open and unobstructed to allow high jumping.

The following call out list of elements can be a useful guide for referencing the element numbers of the drawings.

12 Upper Enclosure Loop
13 Loop Connector Extension
14 Loop Connector
16 Upper Diagonal Member
17 Cross Brace Cover
18 Lower Diagonal Member
19 Diagonal Connection Joint
20 Bed Frame
21 Horizontal Member
22 Frame Leg
23 Frame Leg Connector Bridge
24 Leg Junction
25 Leg Junction Cover
26 Leg Vertical Section
27 Leg Horizontal Section
30 Enclosure Frame
31 Upper Diagonal Connection
32 Middle Diagonal Connection
33 Lower Diagonal Connection
34 Upper Enclosure Opening
35 Middle Enclosure Opening
36 Lower Enclosure Opening
41 Lower Pad
42 Upper Pad
43 Handle Strap
51 Bed
52 Net
60 Enclosure Pole
61 First Lower Branch
62 Second Lower Branch
63 First Upper Branch
64 Second Upper Branch
65 Enclosure Pole Lower Vertical Section
66 Enclosure Pole Upper Vertical Section
70 Right Oriented Spiral Section Members
71 First Right Oriented Spiral Section Member
72 Second Right Oriented Spiral Section Member
73 Third Right Oriented Spiral Section Member
74 Fourth Right Oriented Spiral Section Member
75 Fifth Right Oriented Spiral Section Member
76 Sixth Right Oriented Spiral Section Member
80 Left Oriented Spiral Section Members
81 First Left Oriented Spiral Section Member
82 Second Left Oriented Spiral Section Member
83 Third Left Oriented Spiral Section Member
84 Fourth Left Oriented Spiral Section Member
85 Fifth Left Oriented Spiral Section Member
86 Sixth Left Oriented Spiral Section Member
90 Lower Branch Connectors
91 First Lower Branch Connector
92 Second Lower Branch Connector
93 Third. Lower Branch Connector
94 Fourth Lower Branch Connector
95 Fifth Lower Branch Connector
96 Sixth Lower Branch Connector
100 Upper Branch Connectors
101 First Upper Branch Connector
102 Second Upper Branch Connector
103 Third Upper Branch Connector
104 Fourth Upper Branch Connector
105 Fifth Upper Branch Connector
106 Sixth Upper Branch Connector
110 Intermediate Junctions
111 First Intermediate Junction
112 Second Intermediate Junction
113 Third Intermediate Junction
114 Fourth Intermediate Junction
115 Fifth Intermediate Junction
116 Sixth Intermediate Junction
120 Set Of Frame Legs
121 First Frame Leg
122 Second Frame Leg
123 Third Frame Leg
124 Fourth Frame Leg
125 Fifth Frame Leg
126 Sixth Frame Leg
130 Set Of Frame Leg Connector Bridges
131 First Frame Leg Connector Bridge
132 Second Frame Leg Connector Bridge
133 Third Frame Leg Connector Bridge
134 Fourth Frame Leg Connector Bridge
135 Fifth Frame Leg Connector Bridge
136 Sixth Frame Leg Connector Bridge
140 X-Shaped Panel Structure
141 First X-Shaped Panel
142 Second X-Shaped Panel
143 Third X-Shaped Panel
144 Fourth X-Shaped Panel
145 Fifth X-Shaped Panel
146 Sixth X-Shaped Panel
147 X-Shaped Panel Upper End
148 X-Shaped Panel Lower End
149 X-Shaped Panel Middle

DETAILED DESCRIPTION OF TUE PREFERRED EMBODIMENT

Figure 1:
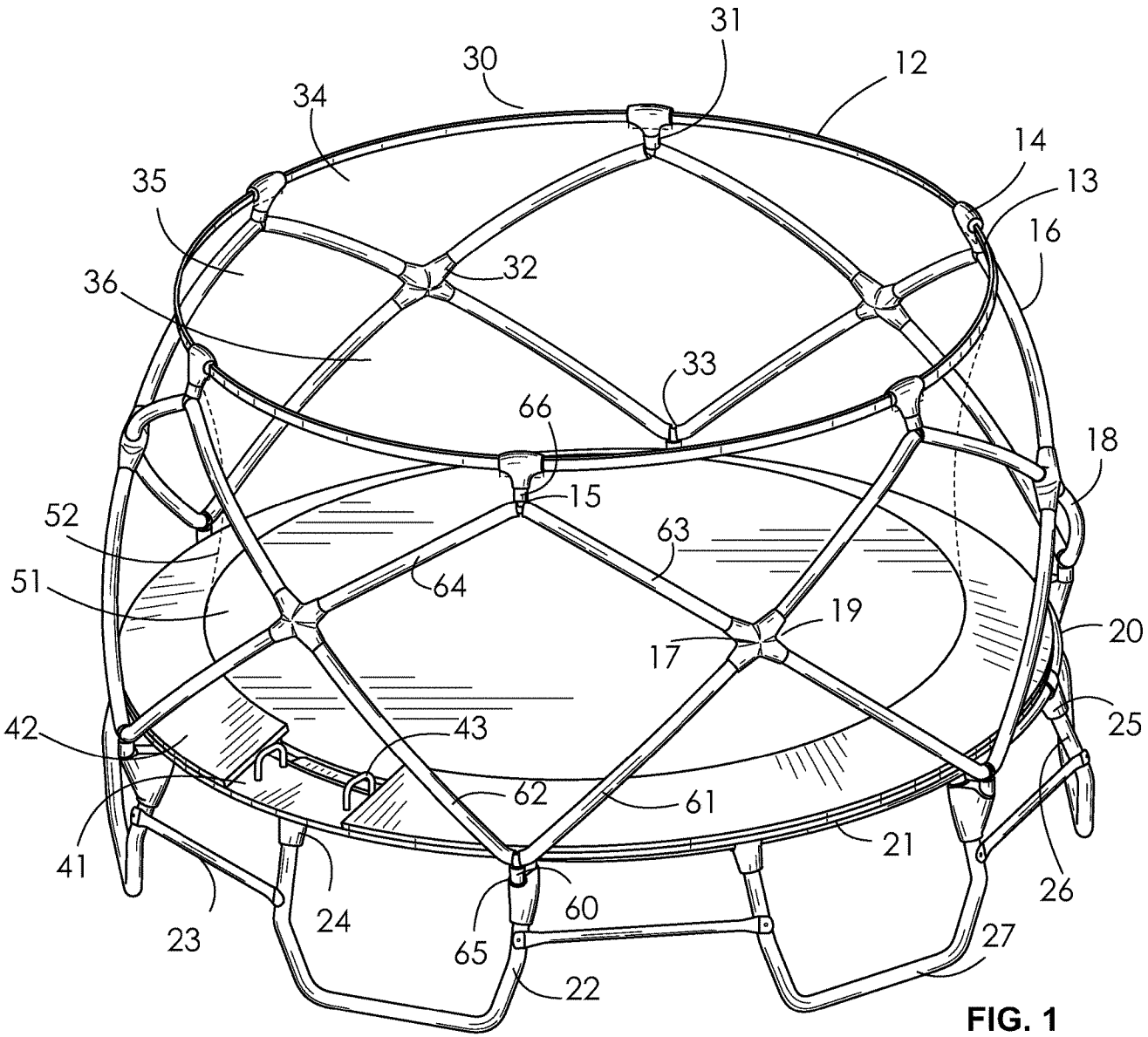
FIG. 1 is a top perspective view.

As seen in FIG. 1, the upper enclosure loop 12 supports a net 52. The net 52 secures the user within the bounds of the trampoline bed. The net 52 surrounds the trampoline bed 51. The bed 51 is supported across a bed frame 20 by springs such as helical springs. The bed 51 provides a surface for a user to rebound upon. The enclosure 30 encloses the user within the enclosure area.

The upper enclosure loop 12 is connected to a loop connector extension 13. The loop connector extension 13 can be formed as a vertically oriented tube that supports a loop connector 14. The loop connector 14 can have a slot for receiving the upper enclosure loop 12. The upper enclosure loop 12 can be made of a spring steel loop or hoop formed in bolted together sections. The loop connector 14 is preferably a metal member, but could be made of high-density plastic as well.

To enter the enclosure 30, a user can enter through an entrance area bounded by a pair of handles straps 43. The entrance area can be a cutout of a trampoline pad system. The trampoline pad system can have a lower pad 41 angled with an upper pad 42. Both can be shock absorbing padded expanded foam members, or can be formed as thin sheets.

The present invention has an enclosure structure that is different from the prior art because the enclosure poles diagonally branch. The loop connector 14 is connected to the lower loop extension 13. The lower loop extension 13 is connected to the upper diagonal member 16 at a loop connector joint 15 and the upper diagonal member 16 is connected to the lower diagonal member 18 at a diagonal connection joint 19. A plastic injection molded cover, or a stamped metal sheet can form a cross brace cover 17 to cover the diagonal connection joint 19.

The enclosure poles can be formed in long sections that include the upper diagonal member 16 and the lower diagonal member 18 formed as a single tubular steel member. The tubular steel member is connected to the bed frame 20 preferably in a rigid connection. The bed frame 20 includes horizontal members 21 that are arc shaped tubular steel members that interconnect with each other. The horizontal members 21 connect to frame legs 22.

The frame legs 22 have a leg vertical section 26 and a leg horizontal section 27, and the leg vertical sections 26 can be connected to each other at a frame leg connector bridge 23. The frame leg connector bridge 23 connects adjacent leg vertical sections 26 of adjacent frame legs 22. The frame legs 22 can be made of a bent U-shaped tubular steel member that connects to leg junctions 24 form the sockets. The leg junctions 24 can be screwed to the tubular portion of the frame legs 22 with self tapping metal screws. The leg junctions 24 are preferably welded tubular steel members. The leg horizontal sections 27 support the leg above the ground and the leg supports the frame above the ground. The frame leg 22 has a pair of leg vertical sections 26 that both connect to leg junctions 24. The leg junction 24 can be covered by a leg junction cover 25 which could be formed by a steel sheet or a plastic injection molded member. The frame leg vertical sections 26 can receive enclosure poles 60. The enclosure poles 60 can begin at an enclosure pole lower vertical section 65 that is connected to the frame leg vertical section 26.

The enclosure frame 30 is formed of interconnected enclosure poles 60. Typical enclosure poles 60 extend upwardly in a generally vertical fashion from the lower diagonal connection 31, but in the present invention, the enclosure poles 60 branch from an enclosure pole lower vertical section 65 that is connected to the leg junction 24 near the upper portion of the leg vertical section 26. The enclosure poles 60 could also be connected to the bed frame 20 at the horizontal member 21, or at the leg junction 24. The branch of the enclosure poles 60 extend outwardly in a diagonal angle from the first lower branch 61 and the second lower branch 62. The pair of lower branches extend outwardly in an upward direction until they join with the diagonal connection joints 19 at the middle diagonal connection 32. Then, the pair of lower branches continue as a first upper branch 63 and a second upper branch 64. The first upper branch 63 is formed of a tubular steel member that is preferably made of a different piece of steel than the first lower branch 51. Similarly, the second upper branch 64 is preferably made of a different piece of steel than the second lower branch 62.

The first upper branch 63 and the second upper branch 64 converge at an upper diagonal connection 31. The diagonal branching of the enclosure poles segments the enclosure 30 into a cylindrical wall having openings, namely an upper enclosure opening 34, a middle enclosure opening 35, and a lower enclosure opening 36. The upper enclosure opening 34 is a triangular shaped opening. The middle enclosure opening 35 is a diagonal shaped opening. The lower enclosure opening 36 is a triangular shaped opening. Preferably, the enclosure wall can be made of long metal tubes that overlie each other and can be bolted together at the diagonal connection joints. If so, the lower enclosure opening 32 would have asymmetrical shape with the upper enclosure opening 34.

Alternatively, the enclosure pole lower vertical section 65 can be formed with a pair of sockets for receiving the first lower branch 51 and the second lower branch 62. Similarly, the enclosure pole upper vertical section 66 can be formed with a pair of sockets for receiving the first upper branch 63 and the second upper branch 64. The angle of the poles should be uniform and the middle enclosure opening 35 is preferably a geometric kite shape. The middle diagonal connection 32 is preferably higher than a midpoint between the lower diagonal connection 33 and the upper diagonal connection 31. The diagonal angle between members means that the members are not parallel or perpendicular to each other.

Figure 2:
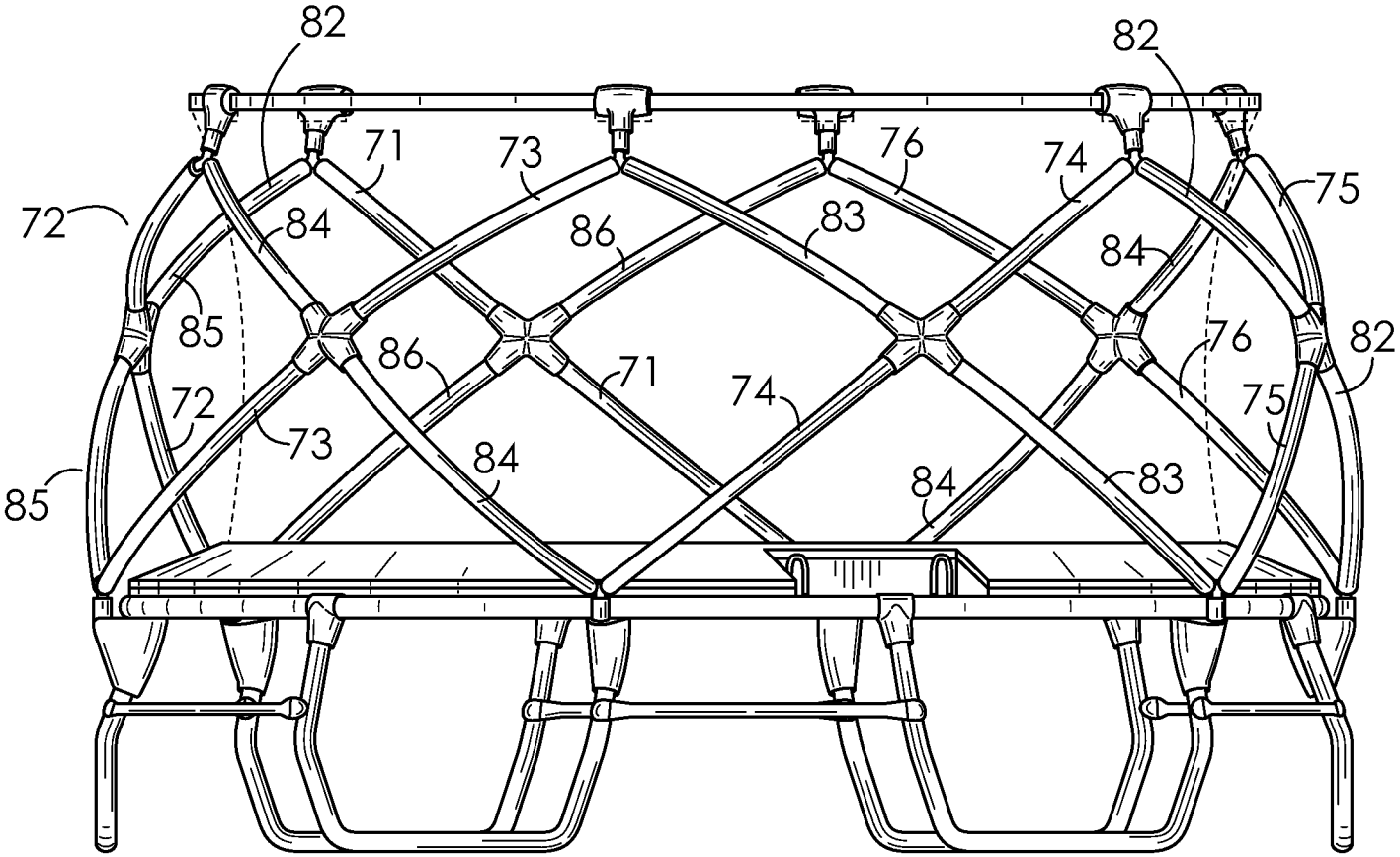
FIG. 2 is a front side view.

As seen in FIG. 2, the trampoline enclosure is made of a plurality of spiral oriented members. The trampoline enclosure includes right oriented spiral section members 70, and left oriented spiral section members 80. The right oriented spiral section members lean to the right as they extend upwardly, and the left oriented spiral section members lean to the left as they extend upwardly.

The right oriented spiral section members 70 are diagonally oriented in a spiral configuration and extend rightward as they extend upwardly. The right oriented spiral section members 70 are symmetrical with each other. When seen from above, the right oriented spiral section members 70 have a right handed orientation that rotates counterclockwise. The right oriented spiral section members 70 have a helical coil configuration. The right oriented spiral section members 70 include a first right oriented spiral section member 71, a second right oriented spiral section member 72, a third right oriented spiral section member 73, a fourth right oriented spiral section member 74, a fifth right oriented spiral section member 75, and a sixth right oriented spiral section member 76.

Similarly, the left oriented spiral section members 80 are diagonally oriented in a spiral configuration and extend leftward as they extend upwardly. The left oriented spiral section members 80 are symmetrical with each other. When seen from above, the left oriented spiral section members 80 have a left handed orientation that rotates clockwise. The left oriented spiral section members 80 have a helical coil configuration. The left oriented spiral section members 80 include a first left oriented spiral section member 81, a second left oriented spiral section member 82, a third left oriented spiral section member 83, a fourth left oriented spiral section member 84, a fifth left oriented spiral section member 85, and a sixth left oriented spiral section member 86.

The right oriented spiral section members 70 and the left oriented spiral section members 80 are preferably formed as curved steel tubular members. The fight oriented spiral section members 70 and the left oriented spiral section members 80 connect with each other at an intermediate joint which is the diagonal connection joint 19. The diagonal connection joint 19 is preferably formed by pressing or otherwise forming a midsection of a curved steel tubular member so that it can be bolted to another midsection of a curved steel tubular member. Thus, the curved steel tubular members that are right oriented are bolted to the curved steel tubular members that are left oriented.

Figure 3:
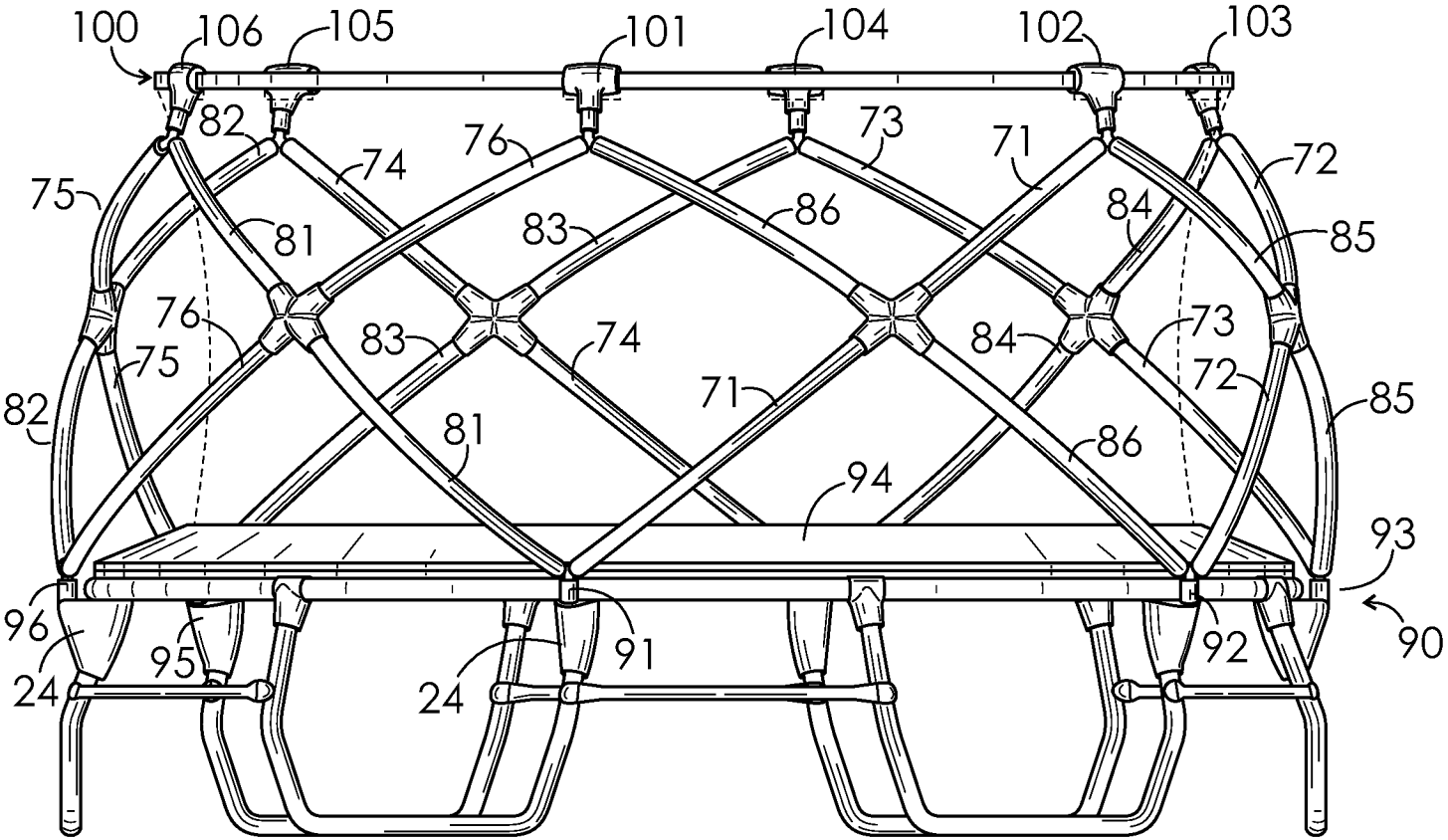
FIG. 3 is a rear side view.
Figure 4:
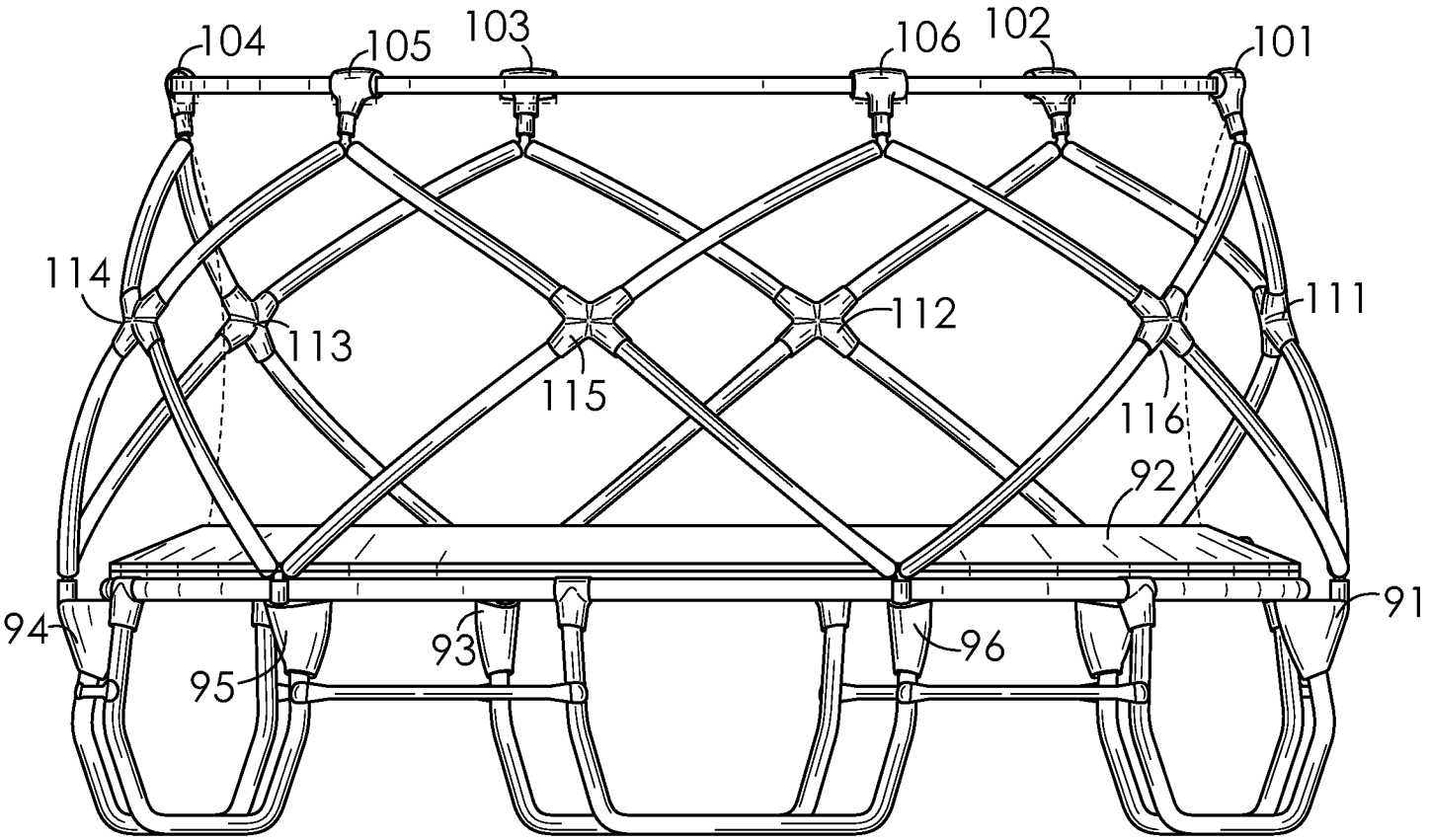
FIG. 4 is a left side view.
Figure 5:
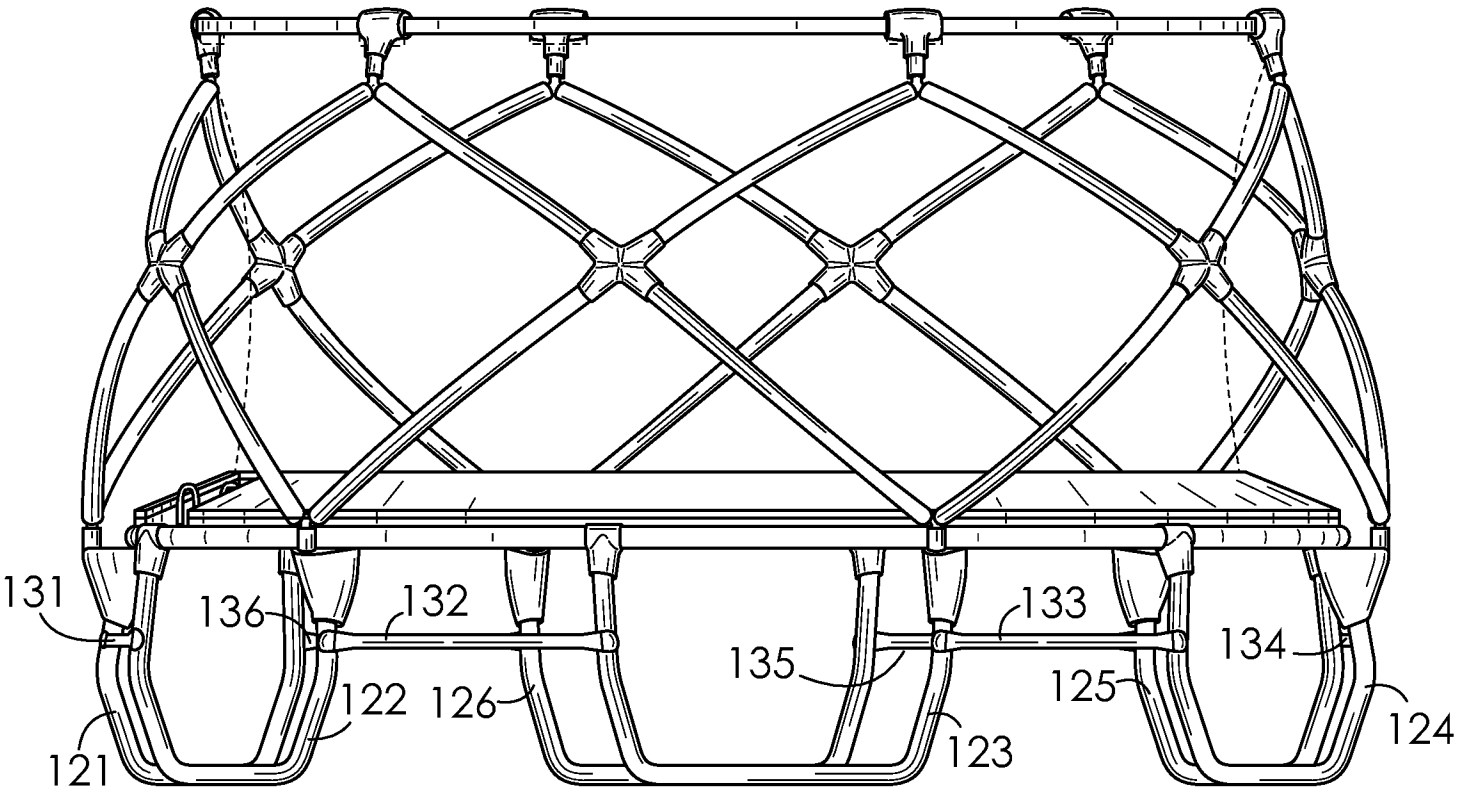
FIG. 5 is a right side view.

As seen in FIG. 3, a rear side view is the same as the front side view. A plurality % of lower branch connectors 90 connect a leg junction 24 to a lower end of the spiral section members, namely the right oriented spiral section members and the left oriented spiral section members. The first right oriented spiral section member 71 is connected to a first lower branch connector 91. The second right oriented spiral section member 72 is connected to a second lower branch connector 92. The third right oriented spiral section member 73 is connected to a third lower branch connector 93. The fourth right oriented spiral section member 74 is connected to a fourth lower branch connector 94. The fifth right oriented spiral section member 75 is connected to a fifth lower branch connector 95. The sixth right oriented spiral section member 76 is connected to a sixth lower branch connector 96.

The first left oriented spiral section member 81 is connected to the first lower branch connector 91. The second left oriented spiral section member 82 is connected to the sixth lower branch connector 96. The third left oriented spiral section member 83 is connected to the fifth lower branch connector 95. The fourth left oriented spiral section member 84 is connected to the fourth lower branch connector 94. The fifth left oriented spiral section member 85 is connected to the third lower branch connector 93. The sixth left oriented spiral section member 86 is connected to the second lower branch connector 92.

Also as seen in FIG. 3, a plurality of upper branch connectors 100 are connected to the left oriented spiral section members and the right oriented spiral section members. The first right oriented spiral section member 71 is connected to the second upper branch connector 102. The second right oriented spiral section member 72 is connected to the third upper branch connector 103. The third right oriented spiral section member 73 is connected to the fourth upper branch connector 104. The fourth right oriented spiral section member 74 is connected to the fifth upper branch connector 105. The fifth right oriented spiral section member 75 is connected to the sixth upper branch connector 106. The sixth right oriented spiral section member 76 is connected to the first upper branch connector 101.

The first left oriented spiral section member 81 is connected to the sixth upper branch connector 106. The second left oriented spiral section member 82 is connected to the fifth upper branch connector 105. The third left oriented spiral section member 83 is connected to the fourth upper branch connector 104. The fourth left oriented spiral section member 84 is connected to the third upper branch connector 103. The fifth left oriented spiral section member 85 is connected to the second upper branch connector 102. The sixth left oriented spiral section member is connected to the first upper branch connector 101.

The first right oriented spiral section member 71 is connected to the first left oriented spiral section member 81 at the first lower branch connector 91.

Figure 6:
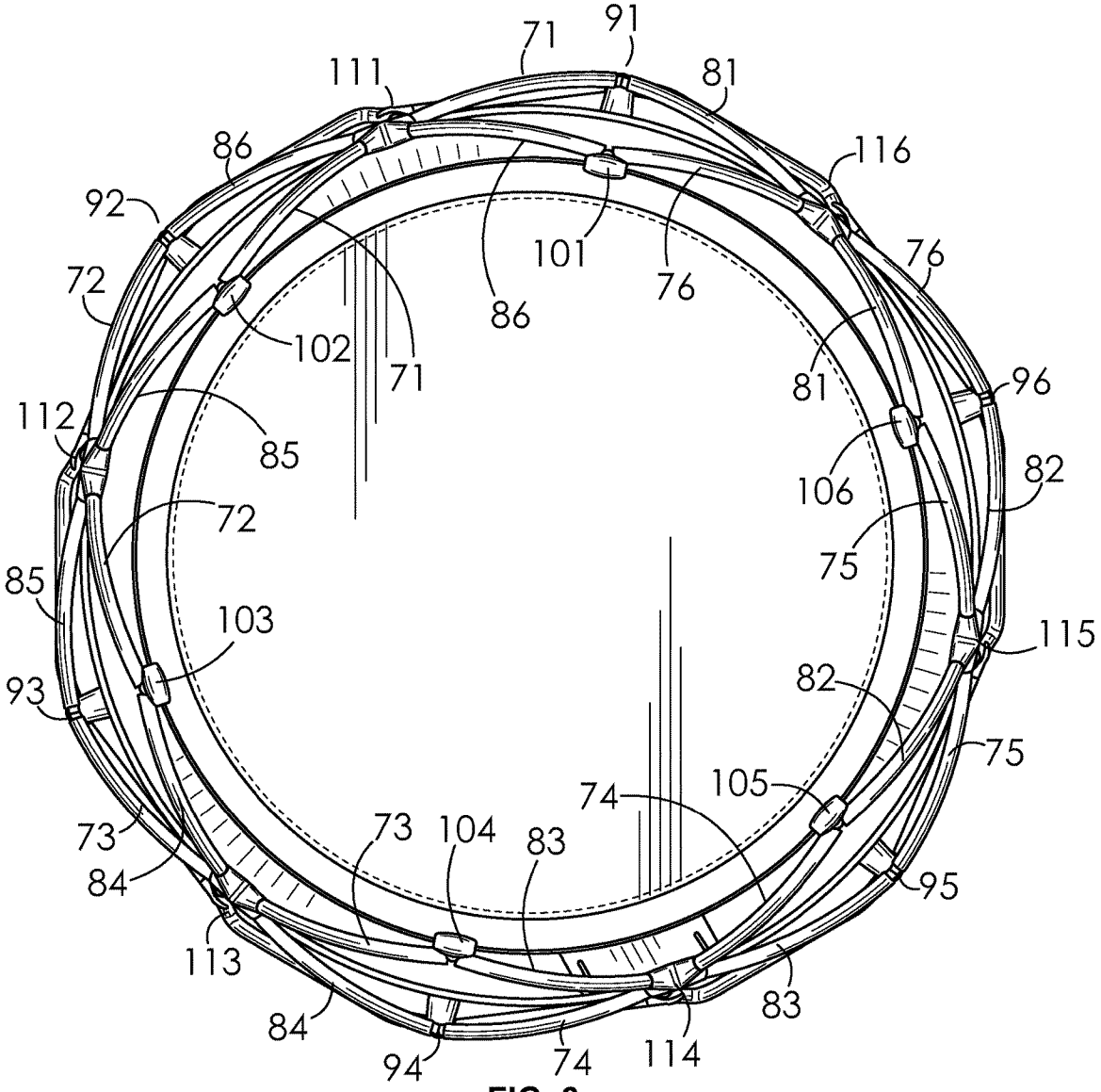
FIG. 6 is a top view.

As seen in FIG. 6, intermediate junctions 110 connect the right oriented spiral section members 70 to the left oriented spiral section members 80 making X shaped frame sections. The first right oriented spiral section member 71 is connected to the sixth left oriented spiral section member at a first intermediate junction 111. The second right oriented spiral section member 72 is connected to the fifth left oriented spiral section member 85 at the second intermediate junction 112. The third right oriented spiral section member 73 is connected to the fourth left oriented spiral section member 84 at the third intermediate junction 113. The fourth right oriented spiral section member 74 is connected to the third left oriented spiral section member 83 at the fourth intermediate junction 114. The fifth right oriented spiral section member 75 is connected to the second left oriented spiral section member 82 at the fifth intermediate junction 115. The sixth right oriented spiral section member 76 is connected to the first left oriented spiral section member 81 at the sixth intermediate junction 116.

Figure 7:
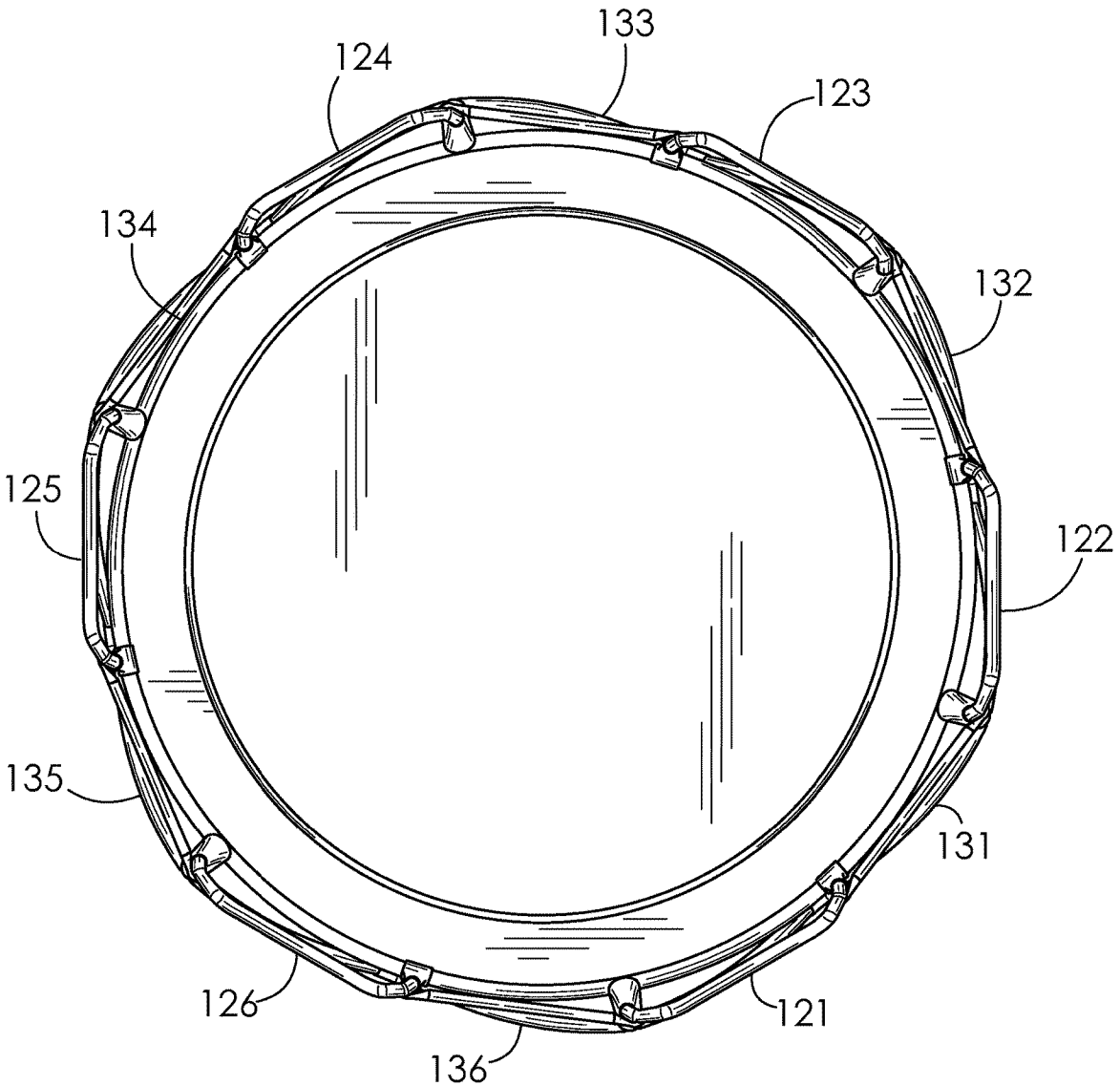
FIG. 7 is a bottom view.
Figure 8:
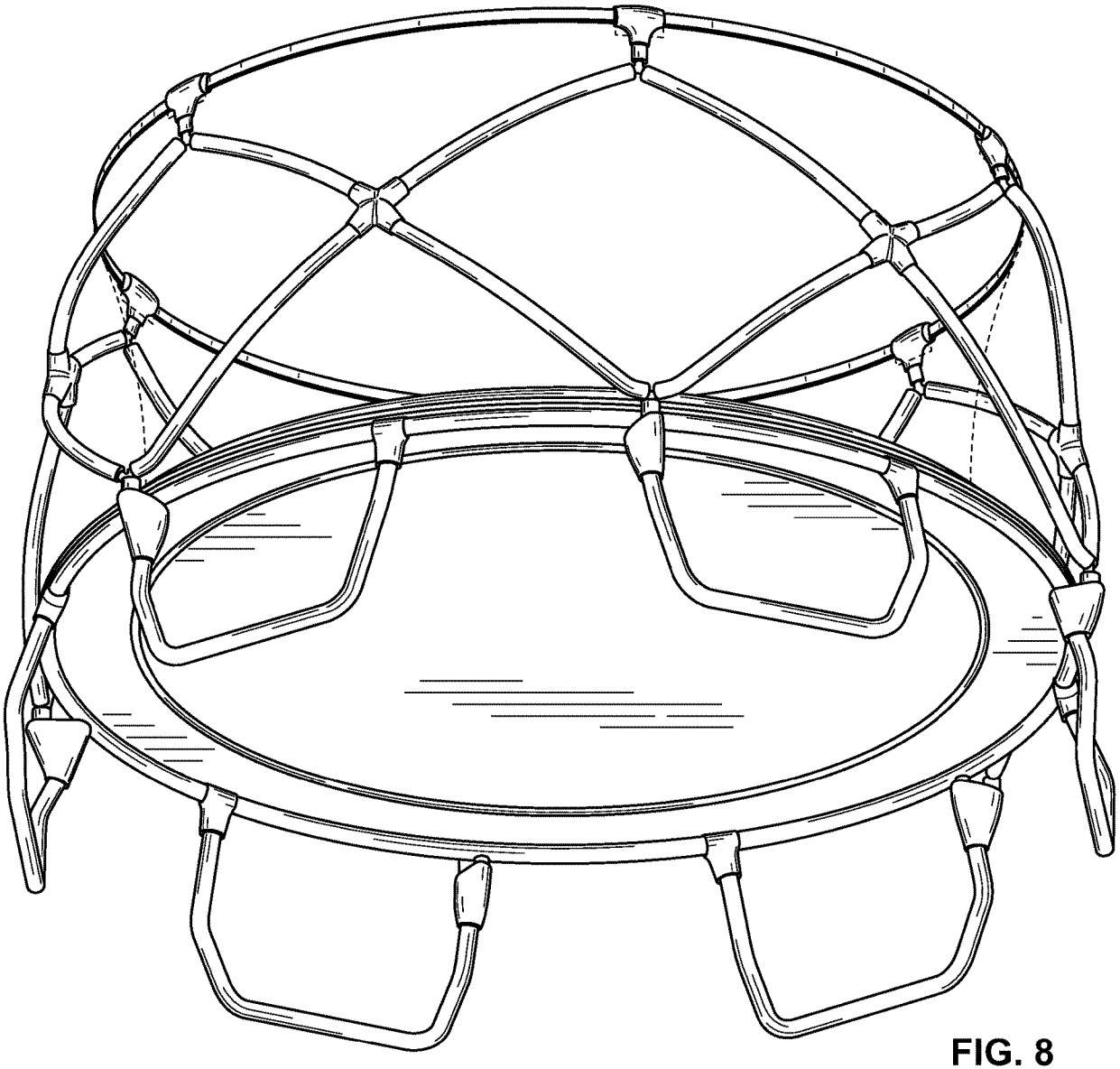
FIG. 8 is a bottom perspective view.

As seen in FIG. 7, the trampoline has a set of frame legs 122 support the frame. More specifically, the trampoline has six frame legs 22, namely a first frame leg 121, a second frame leg 122, a third frame leg 123, a fourth frame leg 124, a fifth frame leg 125, and a sixth frame leg 126. The frame legs 22 are connected to each other by a set of frame leg connector bridges 130 which includes six frame leg connector bridges 23, namely a first frame leg connector bridge 131 connects the first frame leg 121 to the second frame leg 122. A second frame leg connector bridge 132 connects the second frame leg 122 to the third frame leg 123. A third frame leg connector bridge 133 connects the third frame leg 123 to the fourth frame leg 124. A fourth frame leg connector bridge 134 connects the fourth frame leg 124 to the fifth frame leg 125. A fifth frame leg connector bridge 135 connects the fifth frame leg 125 to the sixth frame leg 126. A sixth frame leg connector bridge 136 connects the sixth frame leg 126 to the first frame leg 121.

Figure 9:
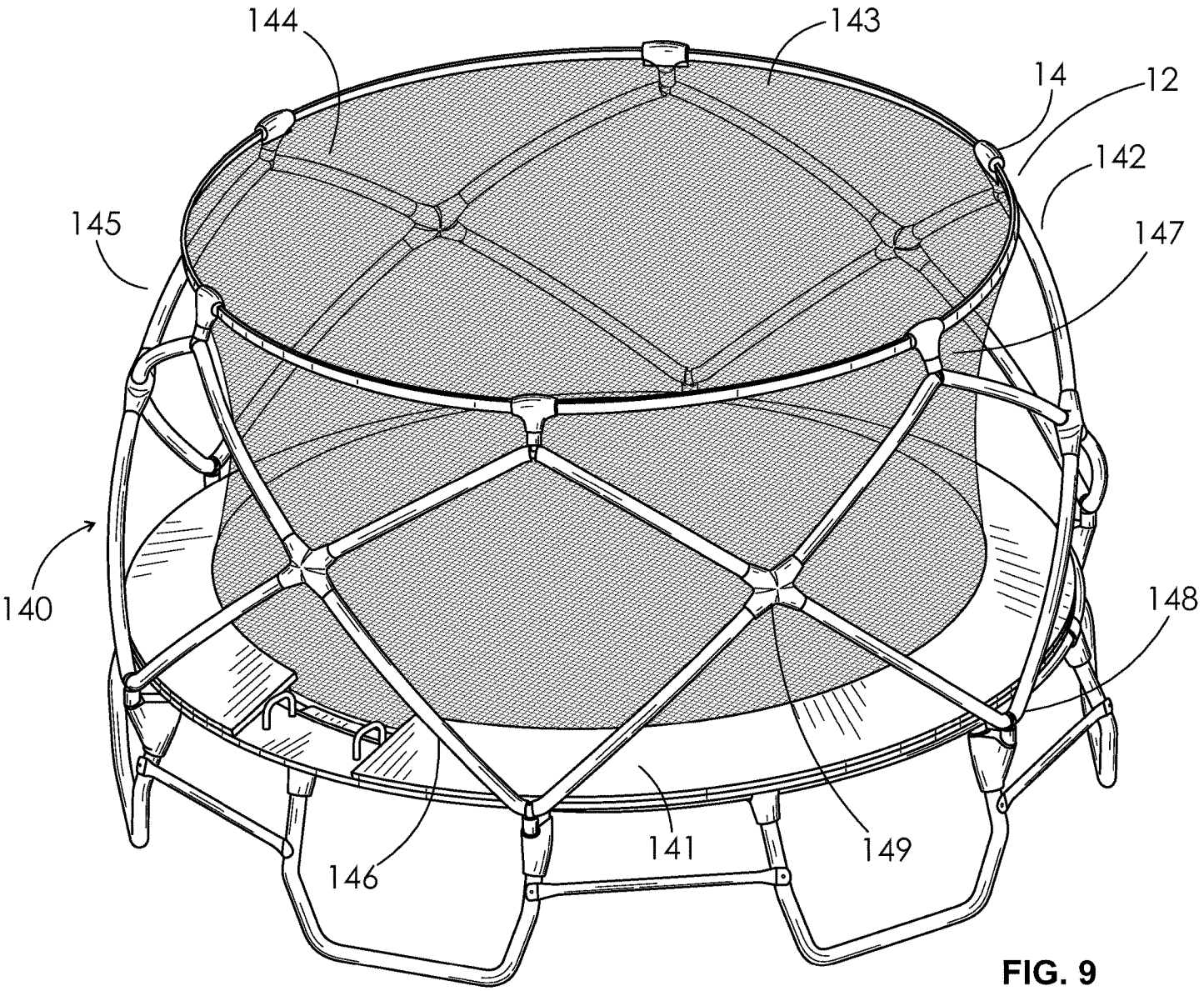
FIG. 9 is a front perspective view showing the trampoline frame with net installed.

As seen in FIG. 9, the trampoline enclosure is made of joined X-shaped panels and a neck shaped panel structure 140. The first X-shaped panel 141 has an X-shaped panel upper end 147 and an shaped panel lower end 148. The first X-shaped panel 141 is connected to the second X-shaped panel 142 at the X-shaped panel upper end 147 and the X-shaped panel lower end 148. The second X-shaped panel 142 is connected to the third X-shaped panel 143, which is connected to the fourth X-shaped panel 144 which is connected to the fifth X-shaped panel 145, which is connected to the sixth X-shaped panel 146, which is connected back to the first X-shaped panel 141.

The X-shaped panel upper end 147 is connected an upper branch connector 100 which connects to an upper enclosure loop 12. The upper branch connector 100 may comprise a loop connector 14 that has a loop connector extension 13 that connects to a pair of adjacent X-shaped panels. The pair of adjacent shaped panels are connected to each other at the upper branch connector and the upper branch connector is connected to the upper enclosure loop 12. The X-shaped panel lower end 148 is connected to the lower branch connectors 90. Each of the lower branch connectors connect the X-shaped panels to each other. For example, the first lower branch connector 91 can connect the first X-shaped panel 141 to the sixth X-shaped panel 146.

The panels preferably connect to each other without overlapping, although portions of the panels may overlap at their connections. The panels are generally trapezoidal in shape having a pair of upper and lower parallel sides. The upper length of the panel is slightly smaller than the lower length of the panel when the panel is leaning inwardly.

The X-shaped panel is formed when the X-shaped structure retains and supports the netting to provide a rectangular or more accurately a trapezoidal shaped support region. Having a flat intersection area in the middle of the X-shaped panel allows a user an area to push off of the netting in case the user jumps away from the center of the trampoline mat.

The invention claimed is:

1. A trampoline comprising:

a. a bed frame;

b. a bed suspended across the bed frame, wherein the bed frame is horizontally oriented bed for suspending the bed;

c. frame legs attached to the frame for supporting the frame above a ground surface;

d. an enclosure including a net suspended from an upper enclosure loop; and e. an enclosure frame comprising enclosure poles formed as right oriented spiral section members and left oriented spiral section members, wherein the enclosure poles are diagonally oriented, wherein the right oriented spiral section members intersect and are connected to the left oriented spiral section members at intermediate junctions to form X-shaped panels, namely a first X-shaped panel, the second X-shaped panel and the third X-shaped panel, wherein the X-shaped panels are connected sequentially to each other at X-shaped panel upper ends and at X-shaped panel lower ends, wherein the first X-shaped panel is connected to a second X-shaped panel, and wherein the second X-shaped panel is connected to a third X-shaped panel, but the third X-shaped panel is not directly connected to the first X-shaped panel, wherein a first lower branch connector connects the first X-shaped panel to the second X-shaped panel, wherein a first upper branch connector connects the first X-shaped panel to the second X-shaped panel, wherein a second lower branch connector connects the second X-shaped panel to the third X-shaped panel, wherein the first lower branch connector is not connected to the second lower branch connector, and wherein the first upper branch connector is not connected to the second upper branch connector, wherein the first upper branch connector and the second upper branch connector are connected to the upper enclosure loop, wherein the frame legs are connected to the lower branch connectors.

2. The trampoline of claim 1, further comprising a cross brace junction cover covering intermediate junctions formed at the the middle of the X-shaped panels.

3. The trampoline of claim 2, wherein the X-shaped panels further include a fourth X-shaped panel connected to the third X-shaped panel, and further including a fifth X-shaped panel connected to the fourth X-shaped panel, and further including a sixth X-shaped panel connected to the first X-shaped panel.

4. The trampoline of claim 3, wherein a first right oriented spiral section member is connected to the first lower branch connector, wherein a second right oriented spiral section member is connected to the second lower branch connector, wherein the third right oriented spiral section member is connected to a third lower branch connector, wherein a fourth right oriented spiral section member is connected to a fourth lower branch connector, wherein a fifth right oriented spiral section member is connected to a fifth lower branch connector, wherein a sixth right oriented spiral section member is connected to a sixth lower branch connector, wherein a first left oriented spiral section member is connected to the first lower branch connector, wherein a second left oriented spiral section member is connected to a sixth lower branch connector, wherein a third left oriented spiral section member is connected to a fifth lower branch connector, wherein a fourth left oriented spiral section member is connected to a fourth lower branch connector, wherein a fifth left oriented spiral section member is connected to the third lower branch connector, and wherein a sixth left oriented spiral section member is connected to the second lower branch connector.

5. The trampoline of claim 3, wherein upper branch connectors are connected to left oriented spiral section members and right oriented spiral section members such that a first right oriented spiral section member is connected to the second upper branch connector, wherein a second right oriented spiral section member is connected to a third upper branch connector, wherein a third right oriented spiral section member is connected to a fourth upper branch connector, wherein a fourth right oriented spiral section member is connected to a fifth upper branch connector, wherein a fifth right oriented spiral section member is connected to a sixth upper branch connector, wherein a sixth right oriented spiral section member is connected to the first upper branch connector, wherein a first left oriented spiral section member is connected to the sixth upper branch connector, wherein a second left oriented spiral section member is connected to the fifth upper branch connector, wherein a third left oriented spiral section member is connected to the fourth upper branch connector, wherein a fourth left oriented spiral section member is connected to the third upper branch connector, wherein a fifth left oriented spiral section member is connected to the second upper branch connector, wherein a sixth left oriented spiral section member is connected to the first upper branch connector.

6. The trampoline of claim 2, wherein intermediate junctions connect the right oriented spiral section members to the left oriented spiral section members making said X-shaped panels, wherein a first right oriented spiral section member is connected to a sixth left oriented spiral section member at a first intermediate junction to make the first X-shaped panel, wherein a second right oriented spiral section member is connected to a fifth left oriented spiral section member at a second intermediate junction to form the second X-shaped panel, wherein a third right oriented spiral section member is connected to a fourth left oriented spiral section member at a third intermediate junction to form a third X-shaped panel, wherein a fourth right oriented spiral section member is connected to the third left oriented spiral section member at a fourth intermediate junction to form a fourth X-shaped panel, wherein a fifth right oriented spiral section member is connected to the second left oriented spiral section member at a fifth intermediate junction to form a fifth X-shaped panel, wherein a sixth right oriented spiral section member is connected to a first left oriented spiral section member at a sixth intermediate junction to form a sixth X-shaped panel.

7. The trampoline of claim 2, further comprising: X-shaped panel lower ends connected to lower branch connectors, wherein the lower branch connectors connect the X-shaped panels to each other and connect the X-shaped panels to trampoline frame legs.

8. The trampoline of claim 2, wherein the upper enclosure loop connected to the enclosure poles at loop connectors mounted at the X-shaped panel upper ends.

9. The trampoline of claim 2, wherein the enclosure is mounted inside the enclosure frame, wherein the enclosure has a smaller diameter than the enclosure frame.

10. The trampoline of claim 2, wherein the first upper branch connector is spaced apart from the second upper branch connector, wherein the first upper branch connector and the second upper branch connector are connected to the upper enclosure loop.

11. The trampoline of claim 1, wherein the X-shaped panels further include a fourth X-shaped panel connected to the third X-shaped panel, and further including a fifth X-shaped panel connected to the fourth X-shaped panel, and further including a sixth X-shaped panel connected to the first X-shaped panel.

12. The trampoline of claim 11, wherein a first right oriented spiral section member is connected to the first lower branch connector, wherein a second right oriented spiral section member is connected to the second lower branch connector, wherein a third right oriented spiral section member is connected to a third lower branch connector, wherein a fourth right oriented spiral section member is connected to a fourth lower branch connector, wherein a fifth right oriented spiral section member is connected to a fifth lower branch connector, wherein a sixth right oriented spiral section member is connected to a sixth lower branch connector, wherein a first left oriented spiral section member is connected to the first lower branch connector, wherein a second left oriented spiral section member is connected to the sixth lower branch connector, wherein a third left oriented spiral section member is connected to the fifth lower branch connector, wherein a fourth left oriented spiral section member is connected to the fourth lower branch connector, wherein a fifth left oriented spiral section member is connected to the third lower branch connector, and wherein a sixth left oriented spiral section member is connected to the second lower branch connector.

13. The trampoline of claim 11, wherein upper branch connectors are connected to left oriented spiral section members and right oriented spiral section members, such that a first right oriented spiral section member is connected to the second upper branch connector, wherein a second right oriented spiral section member is connected to a third upper branch connector, wherein a third right oriented spiral section member is connected to a fourth upper branch connector, wherein a fourth right oriented spiral section member is connected to a fifth upper branch connector, wherein a fifth right oriented spiral section member is connected to a sixth upper branch connector, wherein a sixth right oriented spiral section member is connected to the first upper branch connector, wherein a first left oriented spiral section member is connected to the sixth upper branch connector, wherein a second left oriented spiral section member is connected to the fifth upper branch connector, wherein a third left oriented spiral section member is connected to the fourth upper branch connector, wherein a fourth left oriented spiral section member is connected to the third upper branch connector, wherein a fifth left oriented spiral section member is connected to the second upper branch connector, wherein a sixth left oriented spiral section member is connected to the first upper branch connector.

14. The trampoline of claim 1, wherein intermediate junctions connect the right oriented spiral section members to the left oriented spiral section members making said X-shaped panels, wherein a first right oriented spiral section member is connected to a sixth left oriented spiral section member at a first intermediate junction to make the first X-shaped panel, wherein a second right oriented spiral section member is connected to a fifth left oriented spiral section member at a second intermediate junction to form the second X-shaped panel, wherein a third right oriented spiral section member is connected to a fourth left oriented spiral section member at a third intermediate junction to form a third X-shaped panel, wherein a fourth right oriented spiral section member is connected to the third left oriented spiral section member at a fourth intermediate junction to form a fourth X-shaped panel, wherein a fifth right oriented spiral section member is connected to the second left oriented spiral section member at a fifth intermediate junction to form a fifth X-shaped panel, wherein a sixth right oriented spiral section member is connected to a first left oriented spiral section member at a sixth intermediate junction to form a sixth X-shaped panel.

15. The trampoline of claim 1, further comprising: X-shaped panel lower ends connected to lower branch connectors, wherein the lower branch connectors connect the X-shaped panels to each other and connect the X-shaped panels to trampoline frame legs.

16. The trampoline of claim 1, wherein the upper enclosure loop connected to the enclosure poles at loop connectors mounted at the X-shaped panel upper ends.

17. The trampoline of claim 1, wherein the enclosure is mounted inside the enclosure frame, wherein the enclosure has a smaller diameter than the enclosure frame.

18. The trampoline of claim 1, wherein the first upper branch connector is spaced apart from the second upper branch connector, wherein the first upper branch connector and the second upper branch connector are connected to the upper enclosure loop.

* * * * *